US008535860B2

(12) United States Patent
Katayama et al.

(10) Patent No.: US 8,535,860 B2
(45) Date of Patent: Sep. 17, 2013

(54) ELECTROPHOTOGRAPHIC PHOTORECEPTOR, COATING LIQUID FOR UNDERCOAT LAYER OF ELECTROPHOTOGRAPHIC PHOTORECEPTOR, AND METHOD FOR PRODUCING THE SAME

(75) Inventors: Satoshi Katayama, Nabari (JP); Kohichi Toriyama, Yao (JP); Mami Adachi, Tenri (JP); Kotaro Fukushima, Kawanishi (JP); Junichi Washo, Ikoma (JP)

(73) Assignee: Sharp Kabushiki Kaisha, Osaka (JP)

( * ) Notice: Subject to any disclaimer, the term of this patent is extended or adjusted under 35 U.S.C. 154(b) by 878 days.

(21) Appl. No.: 12/389,502

(22) Filed: Feb. 20, 2009

(65) Prior Publication Data

US 2009/0214970 A1 Aug. 27, 2009

(30) Foreign Application Priority Data

Feb. 21, 2008 (JP) ..... 2008-040301

(51) Int. Cl.
*G03G 5/14* (2006.01)
*B01F 17/00* (2006.01)

(52) U.S. Cl.
USPC ..... 430/65; 430/60; 430/135; 516/20

(58) Field of Classification Search
USPC ..... 516/20; 430/60, 65, 135
See application file for complete search history.

(56) References Cited

U.S. PATENT DOCUMENTS

| | | | | |
|---|---|---|---|---|
| 6,136,484 | A | 10/2000 | Katayama et al. | |
| 6,322,940 | B1 * | 11/2001 | Nishigaki et al. | 430/58.65 |
| 7,125,635 | B2 * | 10/2006 | Wu et al. | 430/64 |
| 8,178,264 | B2 * | 5/2012 | Fuchigami | 430/56 |
| 2003/0211413 | A1 * | 11/2003 | Lin et al. | 430/78 |
| 2007/0048641 | A1 * | 3/2007 | Yahagi | 430/69 |

FOREIGN PATENT DOCUMENTS

| | | |
|---|---|---|
| JP | 48-047344 | 7/1973 |
| JP | 56-052757 | 5/1981 |
| JP | 59-093453 | 5/1984 |
| JP | 64-073353 | 3/1989 |
| JP | 04-172362 | 6/1992 |

* cited by examiner

*Primary Examiner* — Hoa V Le
(74) *Attorney, Agent, or Firm* — Nixon & Vanderhye P.C.

(57) ABSTRACT

A coating liquid for an undercoat layer of an electrophotographic photoreceptor which is formed by sequentially stacking the undercoat layer and a photosensitive layer on an electrically conductive support, wherein the coating liquid comprises titanium oxide microparticles and silicon nitride microparticles as an inorganic compound, a binder resin and an organic solvent.

9 Claims, 3 Drawing Sheets a: length of long axis
b: length of short axis (a) arborescent (b) aciclular

ELECTROPHOTOGRAPHIC PHOTORECEPTOR, COATING LIQUID FOR UNDERCOAT LAYER OF ELECTROPHOTOGRAPHIC PHOTORECEPTOR, AND METHOD FOR PRODUCING THE SAME

CROSS-REFERENCE TO RELATED APPLICATION

This application is related to Japanese Patent Application No. 2008-40301 filed on 21 Feb. 2008, whose priority is claimed under 35 USC §119, and the disclosure of which is incorporated by reference in its entirety.

BACKGROUND OF THE INVENTION

1. Field of the Invention

The present invention relates to an electrophotographic photoreceptor, and more specifically to a coating liquid for an undercoat layer for forming an under coat layer to be disposed between an electrically conductive support and a photosensitive layer and a method for producing the same, and an electrophotographic photoreceptor and an image forming apparatus using the same.

2. Description of the Related Art

Generally, an electrophotographic process using a photoconductive photoreceptor is one of information recording means utilizing a photoconductive phenomenon of a photoreceptor.

In this process, first, surface of a photoreceptor is caused to be uniformly charged by corona discharge in a dark place, and then an image is exposed to light to cause selective discharge of electric charges in the exposed part, whereby an electrostatic image is formed in the part not exposed to light. Then, colored charged microparticles (toner) are adhered to the latent image via electrostatic attractive force or the like to make a visible image, and thus an image is formed.

In the series of processes as described above, for example, the following fundamental characteristics are requested for a photoreceptor.

1) capable of being uniformly charged at an appropriate potential in a dark place;

2) having a high charge retaining ability with little discharging of electric charges in a dark place;

3) having excellent photo sensitivity, and rapidly discharging electric charges in response to light exposure.

It is also requested to be able to readily removing charges on a surface of a photoreceptor, to have small residual potential, to have mechanical strength, excellent flexibility, to cause no variations in electric characteristics, in particular, chargeability, photo sensitivity, residual potential in the case of repeated use, and to have characteristics of great stability and durability, for example, having resistance to heat, light, temperature, humidity, ozone deterioration and the like.

An electrophotographic photoreceptor that is put into practical use at present is constructed by forming a photosensitive layer on an electrically conductive support, however, since carrier injection is likely to occur from the electrically conductive support, an image defect occurs due to microscopic disappearance or reduction of surface electric charges.

In order to prevent such an image defect, and to achieve coverage of the defect on a surface of the electrically conductive support, improvement of chargeability, improvement of adhesion of the photosensitive layer, improvement of coating performance and the like, a measure has been taken to provide an undercoat layer between the electrically conductive support and the photosensitive layer.

Conventionally, as an undercoat layer, those comprising various resin materials, inorganic compound particles, for example, titanium oxide powder and so on are considered.

As a material that is used when an undercoat layer is formed by a resin single layer, examples including resin materials such as polyethylene, polypropylene, polystyrene, an acrylic resin, a vinyl chloride resin, a vinyl acetate resin, a polyurethane resin, an epoxy resin, a polyester resin, a melamine resin, a silicon resin, a polyvinyl butyral resin, a polyamide resin and the like, and copolymer resins including two or more of these repeating units, and additionally, casein, gelatin, polyvinyl alcohol, ethyl cellulose and the like are known, and among these, particularly preferred is a polyamide resin (Japanese Patent Application Laid-Open Publication No. 48-47344).

However, in an electrophotographic photoreceptor in which a resin single layer of polyamide or the like is used as an undercoat layer, accumulation of residual potential is large, so that reduction in sensitivity and fogging in an image occur. This tendency is significant, in particular, in an environment of low humidity.

In view of the above, for a purpose of preventing occurrence of image defect due to influence of the electrically conductive support, or improving the residual potential, those comprising titanium oxide powder having an untreated surface in an undercoat layer (Japanese Patent Application Laid-Open Publication No. 56-52757), those comprising titanium oxide microparticles covered with alumina for improving the dispersibility of titanium oxide powder (Japanese Patent Application Laid-Open Publication No. 59-93453), those comprising metal oxide particles having subjected to a surface treatment with a titanate-based coupling agent (Japanese Patent Application Laid-Open Publication No. 4-172362) and the like have been proposed.

However, proposals in these publications are still insufficient in terms of characteristics, so that there is still a need of an electrophotographic photoreceptor having more excellent characteristics.

It is an object of the present invention to provide a coating liquid for an undercoat layer of an electrophotographic photoreceptor having excellent dispersibility and temporal stability, and excellent coating performance to an electrically conductive support and capable of forming a uniform undercoat layer, and a method for producing the same, and to provide an electrophotographic photoreceptor suffering little change in electric characteristics and having good image characteristics after repeated use, using the coating liquid for an undercoat layer of an electrophotographic photoreceptor, and an image forming apparatus using the electrophotographic photoreceptor.

SUMMARY OF THE INVENTION

As a result of repeating intensive studies, the inventors of the present application found that the above problems are solved by using a coating liquid comprising titanium oxide microparticles and silicon nitride microparticles as an inorganic compound, together with a binder resin, as a coating liquid for an undercoat layer in an electrophotographic photoreceptor for formation of an undercoat layer, and accomplished the present invention.

Therefore, according to the present invention, there is provided a coating liquid for an undercoat layer of an electrophotographic photoreceptor which is formed by sequentially stacking the undercoat layer and a photosensitive layer on an electrically conductive support, wherein the coating liquid comprises titanium oxide microparticles and silicon nitride microparticles as an inorganic compound, a binder resin and an organic solvent.

According to the present invention, there is provided an electrophotographic photoreceptor which is formed by stacking an undercoat layer and a photosensitive layer on an electrically conductive support, wherein the undercoat layer comprises titanium oxide microparticles and silicon nitride microparticles as an inorganic compound and a binder resin.

Further, according to the present invention, there is provided a method for producing a coating liquid for an undercoat layer of an electrophotographic photoreceptor, which comprises dispersing titanium oxide microparticles or titanium oxide microparticles and silicon nitride microparticles as an inorganic compound and a binder resin in an organic solvent.

Further, according to the present invention, there is provided an image forming apparatus equipped with an electrophotographic photoreceptor which is formed by stacking an undercoat layer and a photosensitive layer on an electrically conductive support, wherein the undercoat layer comprises titanium oxide microparticles and silicon nitride microparticles as an inorganic compound and a binder resin.

According to the present invention, it is possible to provide a coating liquid for an undercoat layer of an electrophotographic photoreceptor having excellent dispersibility and temporal stability, and excellent coating performance to an electrically conductive support and capable of forming a uniform undercoat layer, and a method for producing the same. Further, even when it is installed in an apparatus for forming an image by a reversal development process for suppressing injection of electric charges from an electrically conductive support, very excellent image characteristics can be obtained.

Also it is possible to provide an electrophotographic photoreceptor having very stable environmental characteristics, in which deterioration in electric characteristics and image characteristics will not occur after long-term repeated use.

DETAILED DESCRIPTION OF THE PREFERRED EMBODIMENTS

Figure 1:
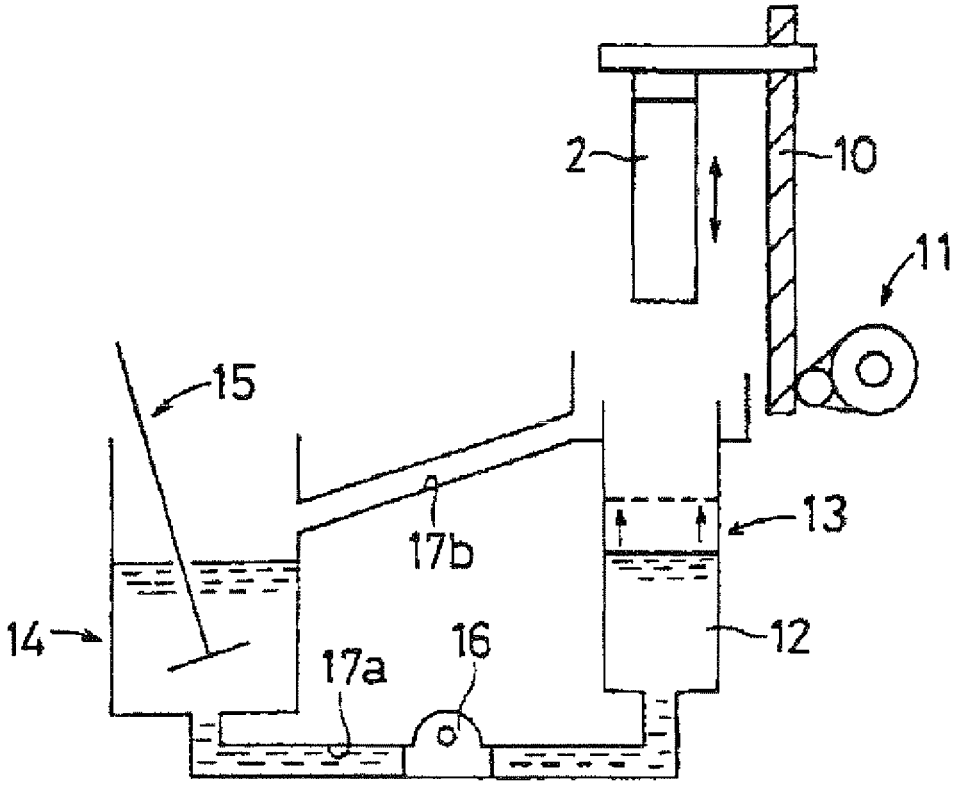
FIG. 1 is a view showing a dip coating apparatus.

In the following, the present invention will be explained more specifically.

As the electrically conductive support used in the present invention, a drum or a sheet formed of metal such as aluminum, aluminum alloy, copper, zinc, stainless, titanium and the like, a drum, a sheet and a seamless belt in which metal foil lamination or metal vapor deposition treatment is applied on a polymer material such as polyethylene terephthalate, nylon and polystyrene, or on hard paper can be recited.

In the present invention, the coating liquid for an undercoat layer of an electrophotographic photoreceptor to be applied on a surface of the electrically conductive support comprises a binder resin, and titanium oxide microparticles and silicon nitride microparticles as an inorganic compound, and the silicon nitride microparticles are comprised in a proportion of 0.1 to 20% by weight, preferably 0.5 to 10% by weight, and more preferably 1 to 5% by weight, relative to the titanium oxide microparticles.

Further, in the present invention, the titanium oxide microparticles each have an acicular or arborescent shape.

Further, in the present invention, a weight ratio of the inorganic compound, to the binder resin is 10/90 to 95/5.

The coating liquid for an undercoat layer of an electrophotographic photoreceptor according to the present invention realizes excellent dispersibility and temporal stability, and excellent coating performance to an electrically conductive support and is able to form a uniform undercoat layer coating film in formation of photosensitive layer, by comprising titanium oxide microparticles and silicon nitride microparticles.

In the electrophotographic photoreceptor, after forming the coating liquid for an undercoat layer of an electrophotographic photoreceptor on an electrically conductive support, a photosensitive layer is formed.

An electrophotographic photoreceptor formed by using the coating liquid for an undercoat layer of an electrophotographic photoreceptor is able to prevent an image defect originating from a defect in the electrically conductive support while keeping predetermined electric characteristics between the electrically conductive support and the photosensitive layer. In particular, by forming this excellent undercoat layer and producing an electrophotographic photoreceptor using an organic material having light sensitivity at long wavelength such as a phthalocyanine pigment as a charge generating substance, and installing the resultant electrophotographic photoreceptor to an image forming apparatus utilizing a reversal development method, it is possible to exert excellent image characteristics having no micro black dots (black spots) in white base that is peculiar to reversal development due to reduction or disappearance of surface charges in a micro region.

In the above electrophotographic photoreceptor, a film thickness of an undercoat layer is 0.05 to 5 μm in the electrophotographic photoreceptor that comprises an electrically conductive support, an undercoat layer formed on the electrically conductive support, and a photosensitive layer formed on the undercoat layer.

In a conventional undercoat layer, although environmental characteristics are improved by reducing the film thickness, adhesion between the electrically conductive support and the photosensitive layer decreases, and an image defect resulting from defect in electrically conductive support may disadvantageously occur. On the other hand, increasing the film thickness of the undercoat layer may lead decrease in sensitivity, and cause deterioration in environmental characteristics. Therefore, practical film thickness is limited for achieving a good balance between reduction in an image defect and improvement in stability of electric characteristics.

However, by comprising titanium oxide microparticles and silicon nitride microparticles, dispersibility in the undercoat layer improves so that it is possible to keep the resistance uniformly. As a result, variation in microscopic photoreceptor characteristics, in particular, sensitivity or residual potential is suppressed, and occurrence of image defect can be prevented.

In the above electrophotographic photoreceptor, the binder resin comprised in the undercoat layer is a polyamide resin that is soluble to an organic solvent.

Since a polyamide resin as a binder resin comprised in the undercoat layer well blends with inorganic compound particles, and has excellent adhesion with the electrically conductive support, the formed undercoat layer comprising a polyamide resin is able to keep flexibility of a film.

Further, since there is no opportunity of swelling or dissolving with a solvent for a photoreceptor coating liquid, it is possible to provide an electrophotographic photoreceptor having excellent image characteristics while preventing occurrence of coating defect or unevenness of the undercoat layer.

In preparation of a coating liquid for an electrophotographic photoreceptor undercoat of the present invention, a commonly-used dispersing media made of zirconia or silicon nitride may be used in dispersing a binder resin and titanium oxide microparticles and silicon nitride microparticles as an inorganic compound. However, in dispersing a binder resin and titanium oxide, a dispersing medium made of silicon nitride is used in the present invention.

The image forming apparatus is characterized by being equipped with the above electrophotographic photoreceptor.

In the image forming apparatus equipped with the above electrophotographic photoreceptor, variation in electric characteristics due to repeated use is small, and very excellent image characteristics are exhibited even in the case of variation in environmental characteristics.

In the undercoat layer of the electrophotographic photoreceptor according to the present invention, titanium oxide microparticles and silicon nitride microparticles are comprised as an inorganic compound.

Figure 2:
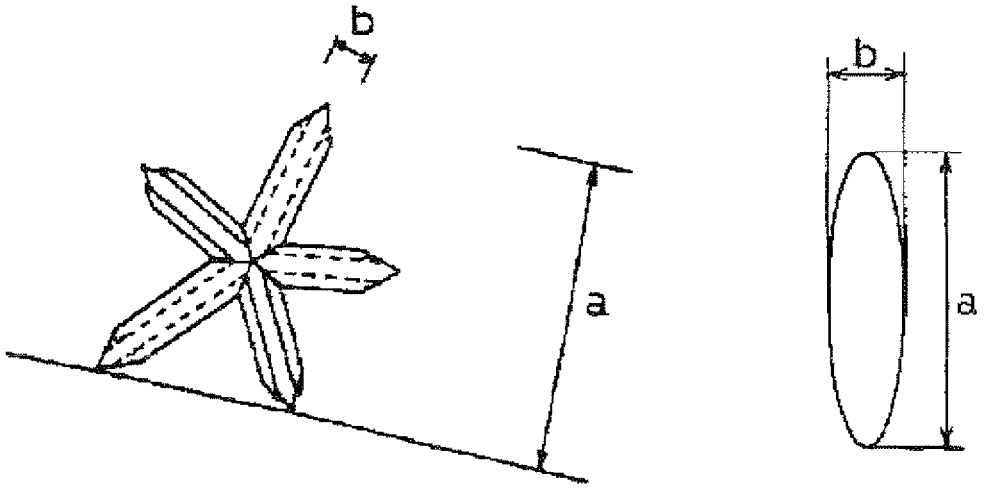
FIG. 2A is a view showing acicular titanium oxide.
FIG. 2B is a view showing arborescent titanium oxide.

A crystal type of the above titanium oxide may be any of rutile-type, anatase-type, and amorphous, and as the shape thereof, particles are commonly used, however, those having aciculate or arborescent shape as shown in FIG. 2 are preferred.

In the present invention, the term "aciculate" used regarding the crystal shape of an inorganic compound implies any elongated shapes including bar shape, column shape and spindle shape, and hence it is not necessarily an extremely elongated shape, and not necessarily a shape with acute tip end.

Likewise, the term "arborescent" implies any branched shapes of elongated shapes including bar shape, column shape and spindle shape, namely branched shapes of the above aciculate shapes.

As for a particle size of aciculate or arborescent titanium oxide microparticles, preferably, a length of the long axis a is 100 μm or less and a length of the short axis b is 1 μm or less, and more preferably the length of the long axis a is 10 μm or less and the length of the short axis b is 0.5 μm or less, and "aciculate" means the shape having an aspect ratio which is a ratio a/b of the length of the long axis and the length of the short axis b of 1.5 or larger.

When the length of axis of the aciculate or arborescent is larger than the above range, a coating liquid for an under coat layer having dispersion stability is difficult to be obtained when a surface treatment with metal oxide or an organic compound is conducted.

Further, an aspect ratio of a particle is preferably in the range of 1.5 or more and 300 or less, and more preferably in the range of 2 or more and 10 or less.

As for a method of measuring a particle size and an aspect ratio, measurement may be achieved by weight sedimentation or light transmission type size distribution measuring method, however it is preferred to directly measure under an electric microscopy because the shape is aciculate or arborescent.

In the undercoat layer, aciculate or arborescent titanium oxide microparticles and silicon nitride microparticles are comprised as an inorganic compound, and it is preferred that a binder resin is comprised in order that dispersibility of such an inorganic compound is retained for a long term as a coating liquid for an under coat layer and that a uniform film is formed as an undercoat layer.

Content of the aciculate or arborescent titanium oxide microparticles and silicon nitride microparticles in the undercoat layer is in the range of 10% by weight or more and 99% by weight or less, preferably in the range of 30% by weight or more and 99% by weight or less, and more preferably in the range of 35% by weight or more and 95% by weight or less.

When the content is less than 10% by weight, sensitivity decreases, and electric charges accumulate in the undercoat layer so that the residual potential increases. This is particularly significant in repeating characteristics under low temperature and low humidity.

On the other hand, a content of more than 95% by weight is not preferred because storage stability of the coating liquid for an under coat layer is poor, and sedimentation of aciculate or arborescent titanium oxide microparticles and silicon nitride microparticles is more likely to occur.

In the present invention, a mixture of aciculate or arborescent titanium oxide microparticles and particulate titanium oxide microparticles may be used. In every case where aciculate or arborescent, or particulate titanium oxide is used, any of anatase-type, rutile-type, amorphous, or a mixture of two or more kinds may be used as a crystal shape of the titanium oxide.

A volume resistance of aciculate or arborescent titanium oxide microparticles powder is preferably $10^5$ to $10^{10}$ Ωcm.

When the volume resistance of powder is less than $10^5$ Ωcm, resistance as the undercoat layer decreases and it no longer functions as a charge blocking layer. For example, in the case of an inorganic compound particles having subjected to a treatment, for example, with tin oxide conductive layer doped with antimony, a volume resistance of powder is as small as $10^0$ Ωcm to $10^1$ Ωcm, so that the undercoat layer using the same no longer functions as a charge blocking layer, and chargeability as the photoreceptor characteristics is impaired and fogging and black dots (black spots) occur in the image. Therefore, such particles are unusable.

Further, when the volume resistance of powder of the aciculate or arborescent titanium oxide microparticles is $10^{10}$ Ωcm or higher, and thus is equal to or higher than a volume resistance of the binder resin itself, resistance as the undercoat layer is too high, and transportation of carries generating at the time of light exposure is suppressed and prevented, to lead increase in residual potential and reduction in light sensitivity. Therefore, such particles are undesired.

As far as the volume resistance of powder of aciculate or arborescent titanium oxide microparticles is kept within the above range, a surface of aciculate or arborescent titanium oxide microparticles may be covered with metal oxide such as $Al_2O_3$, $ZrO_2$ or the like or a mixture thereof. When titanium oxide microparticles having an untreated surface are used, aggregation of titanium oxide microparticles is inevitable during long-term use or storage of a coating liquid even in the case of a coating liquid for an under coat layer in which particles of titanium oxide to be used are microparticles and hence are sufficiently dispersed. Therefore, in forming an undercoat layer, a defect of a coating film and unevenness of coating occur, and thus an image defect occurs. Further, since injection of electric charges from the electrically conductive support is more likely to occur, chargeability in the micro region decreases, and black dots occur.

In view of the above, by covering a surface of the aciculate or arborescent titanium oxide microparticles with metal oxide such as $Al_2O_3$, $ZrO_2$ or a mixture thereof, a coating liquid for an under coat layer having very excellent dispersibility and storage stability is obtained while aggregation of aciculate or arborescent titanium oxide is prevented.

Furthermore, since injection of electric charges from the electrically conductive support can be prevented, it is possible to obtain an electrophotographic photoreceptor having excellent image characteristics with no black dots. As metal oxide for covering a surface of aciculate or arborescent titanium oxide, $Al_2O_3$ and $ZrO_2$ are preferred. More excellent image characteristics are obtained and more preferred effect is realized by conducting a surface treatment with different metal oxides such as $Al_2O_3$ and $ZrO_2$.

When surface of titanium oxide is covered with metal oxide having magnetism such as $Fe_2O_3$, chemical interaction with a phthalocyanine pigment comprised in the photosensitive layer occurs, and the photoreceptor characteristics, in particular, sensitivity and chargeability deteriorate. Therefore, this measure is not desirable.

A surface treatment amount of $Al_2O_3$, $ZrO_2$, used as metal oxide for covering a surface of aciculate or arborescent titanium oxide is preferably from 0.1% by weight to 20% by weight, relative to titanium oxide. When the treatment amount is less than 0.1% by weight, it is impossible to sufficiently cover the surface of the titanium oxide, so that effect of a surface treatment is less likely to appear. When the treatment amount is more than 20% by weight, the surface treatment is sufficiently effected, so that the characteristics will not further change, and a more amount is undesirable because of cost rise.

As an organic compound for covering a surface of aciculate or arborescent titanium oxide, a generally used coupling agent may be used.

As the kind of coupling agent, silane coupling agents such as an alkoxy silane compound, silylation agents in which halogen, nitrogen, sulfur or the like atom is bound with silicon, titanate-based coupling agents, aluminum-based coupling agents and the like can be recited.

For example, examples of a silane coupling agent include, but are not limited to alkoxy silane compounds such as tetramethoxy silane, methyltrimethoxy silane, dimethyldimethoxy silane, ethyltrimethoxy silane, diethyldimethoxy silane, phenyltriethoxy silane, aminopropyltrimethoxy silane, γ-(2-aminoethyl)aminopropyl methyldimethoxy silane, allyltrimethoxy silane, allyltriethoxy silane, 3-(1-aminopropoxy)-3,3-dimethyl-1-propenyltrimethoxy silane, (3-acryloxypropyl)trimethoxy silane, (3-acryloxypropyl)methyldimethoxy silane, (3-acryloxypropyl)dimethylmethoxy silane, and N-3-(acryloxy-2-hydroxypropyl)-3-aminopropyltriethoxy silane; chloro silanes such as methyltrichloro silane, methyldichloro silane, dimethyldichloro silane and phenyltrichloro silane; silazanes such as hexamethyl disilazane and octamethycyclotetra silazane; titanate-based coupling agents such as isopropyl triisostearoyl titanate; aluminum-based coupling agents such as acetoalkoxy aluminum diisopropylate, and bis(dioctyl pyrophoate).

When the surface treatment is conducted on the titanium oxide microparticles with such a coupling agent, or when such a coupling agent is used as a dispersing agent, one kind or two or more kinds of coupling agents may be used in combination.

Methods of conducting the surface treatment on titanium oxide microparticles are generally classified into a pretreatment method and an integral blend method, and the pretreatment method is further classified into a wet method and a dry method.

The wet method is classified into a water treatment method, and a solvent treatment method, and the water treatment method includes a direct solving method, an emulsion method, an amine adduct method and the like.

In the case of a wet method, a surface treatment may be conducted by adding titanium oxide particles to a surface treatment agent dissolved or suspended in an organic solvent or water, and stirring and mixing the resultant solution for several minutes to about one hour, and drying through a process of filtration or the like after heating treatment as is necessity.

Similarly, a surface treatment agent may be added to a suspension in which titanium oxide particles are dispersed in an organic solvent or water.

As a surface treatment agent which may be used, a treatment agent which is soluble to water in the case of a direct method, a treatment agent which is emulsifiable in water in the case of emulsion method, and a treatment agent having a phosphoric acid residue in the case of an amine adduct method are recited.

In the case of an amine adduct method, it is preferred to conduct the treatment while adjusting pH of preparation to 7 to 10 by adding a small amount of tertiary amine such as trialkyl amine or trialkylol amine, and cooling so as to prevent rise in a liquid temperature by the neutralization exothermic reaction, and other steps may be conducted in a similar manner as other wet methods to achieve a surface treatment. However, as a surface treatment agent that can be used in the case of a wet method, only those solvable or suspendable in an organic solvent or water being used are acceptable.

As a dry method, a surface treatment may be achieved by directly adding a surface treatment agent to the titanium oxide microparticles and stirring and mixing by a mixer. As a general method, it is preferred to conduct predrying for removing surface water on the titanium oxide microparticles. For example, after conducting predrying at a temperature around 100° C. at several tens rpm in a mixer having larger share such as a hayshal mixer, a surface treatment agent is added directly or in a solution dissolved or dispersed in an organic solvent or water. At that time, more uniform mixing is achieved by conducting the treatment while spraying dry air or $N_2$ gas. At the time of addition, it is preferred to stir for several tens minutes at a temperature around 80° C., at a rotation speed of 1000 rpm or more.

The integral blend method is a method of adding a surface treatment agent in kneading titanium oxide microparticles with resin, and is generally used in the field of coating material. An adding amount as the surface treatment agent and the additive varies depending on the kind and form of the metal oxide particles, however, it is 0.01% by weight to 30% by weight, and preferably 0.1% by weight to 20% by weight of metal oxide particles. When the adding amount is less than this range, an effect of addition is less likely to appear, whereas when the adding amount is more than this range, there is no significant change in an effect of addition and a disadvantage in cost aspect arises.

Further, as for the surface of the titanium oxide microparticles, when such a treatment is executed, surface of the titanium oxide microparticles may be untreated insofar as volume resistance of powder of the titanium oxide microparticles can be kept within the aforementioned range, and further, may be covered with metal oxides such as $Al_2O_3$, $ZrO_2$ or a mixture thereof before and after a treatment with a coupling agent having an unsaturated bond, and also in the case of adding to an organic solvent as a dispersing agent.

As the silicon nitride microparticles used in the present invention, trisilicon tetranitride ($Si_3N_4$) having a general composition is representative; however, those having other compositions such as monosilicon mononitride ($Si_1N_1$) and the like may be used. As for the crystal structure, any known crystal structure including a type, β type and the like may be used. As a method for producing silicon nitride microparticles, direct nitriding method, reductive nitriding method, imide degradation method and the like have been developed, however, they may be produced in any of these production methods. The shape of silicon nitride used in the present invention is not particularly limited, however, microparticles are preferred because they have excellent characteristics compared to other metal oxides and ceramics, namely, very high strength, fracture toughness and the like.

Film thickness of the undercoat layer is preferably between 0.01 μm and 10 μm, and more preferably between 0.05 μm and 5 μm. When the film thickness of the undercoat layer is less than 0.01 μm, it substantially fails to function as an undercoat layer, fails to obtain uniform surface property by covering defects of the electrically conductive support, and fails to prevent injection of carriers from the electrically conductive support, so that chargeability decreases. A film thickness of more than 10 μm is not preferable because difficulty arises in production of a photoreceptor and sensitivity of a photoreceptor decreases when an undercoat layer is dip coated.

As a binder resin comprised in the undercoat layer, similar material is used as that in forming an undercoat layer in a resin single layer. For example, resin materials including polypropylene, polystyrene, an acrylic resin, a vinyl chloride resin, a vinyl acetate resin, a polyurethane resin, an epoxy resin, a polyester resin, a melamine resin, a silicon resin, a butyral resin, a polyamide resin and the like, and copolymer resins including two or more of these repeating units, and additionally, casein, gelatin, polyvinyl alcohol, ethyl cellulose and the like are known. Among these, a polyamide resin, butyral resin, and vinyl acetate resin that are soluble to alcohol are preferred, and a polyamide resin is more preferred.

This is because as characteristics of a binder resin, the following characteristics are required: not causing dissolution or swelling with respect to solvent used in forming a photoreceptor layer on the undercoat layer; having excellent adhesion with the electrically conductive support and flexibility; having good affinity with metal oxide comprised in the undercoat layer and having excellent dispersibility of metal oxide particles and excellent storage stability of dispersion.

Among polyamide resins, more preferably, an alcohol-soluble nylon resin may be used. For example, so-called copolymer nylons in which, for example, 6-nylon, 66-nylon, 610-nylon, 11-nylon, 12-nylon and the like are copolymerized, and chemically modified nylons such as N-alkoxymethyl modified nylon and N-alkoxyethyl modified nylon are preferred.

As a method of dispersing the coating liquid for an under coat layer, an ultrasonic disperser not using a dispersing medium, or a disperser using a dispersing medium such as ball mill, beads mill, paint conditioner or the like may be used, and preferred is a disperser using a dispersing medium capable of introducing an inorganic compound into a binder resin solution dissolved in an organic solvent, and dispersing the inorganic compound by strong force applied from the disperser via the dispersing medium.

As a material of the dispersing medium, it is general to use glass, zircon, alumina, and preferably zirconia, titania having high abrasion resistance, however, as the material of a dispersing medium used in the present invention, silicon nitride is further preferred.

It was found that when a dispersing medium made of silicon nitride was used as the dispersing medium, an effect similar to that in the case where titanium oxide and silicon nitride were added to the coating liquid was obtained even if silicon nitride microparticles were not added to the coating liquid for an under coat layer.

It appears that when a dispersing medium made of silicon nitride is used, an effect similar to that in the case where silicon nitride is added to the coating liquid is obtained because the silicon nitride occurring by abrasion of a medium during the dispersing process is dispersed.

The shape of the dispersing medium may be a bead of 0.3 millimeters to several millimeters, or a ball of several centimeters.

When glass is used as a material of the dispersing medium, viscosity of the dispersion increases, and storage stability is impaired, and when titania or zirconia is used, variation in electric characteristics by repeated uses increases so that an image defect occurs.

When a dispersing medium of silicon nitride is used in production of an electrophotographic photoreceptor according to the present invention, viscosity of dispersion will not increase, and a dispersion having excellent storage stability is obtained, and further, an electrophotographic photoreceptor having excellent electric characteristics and image characteristics by repeated use, and an image forming apparatus equipped with the electrophotographic photoreceptor can be obtained.

This is attributable to the fact that in dispersing the titanium oxide microparticles used in the present invention, the strong force given from the disperser is used not only as energy for dispersing titanium oxide microparticles but also, as energy for abrading the dispersing medium itself, so that a material of the dispersing medium enters the dispersed coating liquid, and exerts some influences on dispersibility and storage stability of dispersed coating liquid, coating performance in formation of an undercoat layer of an electrophotographic photoreceptor, and film quality of the undercoat layer.

It is also conceivable that by using a dispersing medium made of silicon nitride in a dispersing step, rise in a liquid temperature of the dispersed coating liquid is prevented by taking advantage of heat conductivity that is higher than that of the dispersing medium made of zirconia, and alternation of titanium oxide and binder resin which are constituting material of the undercoat layer is reduced and some interaction exerts, so that electric characteristics, environmental characteristics and image characteristics by repeated use are greatly improved, however, the mechanism thereof is still unclear.

As an organic solvent used in the coating liquid for an undercoat layer of an electrophotographic photoreceptor according to the present invention, a generally used organic solvent may be used, and when a more preferred alcohol-soluble nylon resin is used as a binder resin, an organic solvent of a single system and a mixed system selected from C1 to C4 lower alcohol groups, and a group consisting of dichloromethane, chloroform, 1,2-dichloroethane, 1,2-dichloropropane, toluene, and tetrahydrofuran is used.

More specifically, it is preferred that a solvent of the coating liquid for an under coat layer is a mixed solvent of an azeotropic composition of a lower alcohol selected from the group consisting of methyl alcohol, ethyl alcohol, isopropyl alcohol and normal propyl alcohol, and other organic solvent selected from the group consisting of dichloromethane, chloroform, 1,2-dichloroethane, 1,2-dichloropropane, toluene, and tetrahydrofuran.

By applying a coating liquid prepared by dispersing the polyamide resin and the titanium oxide microparticles, and silicon nitride microparticles in a mixed solvent of the lower alcohol and the organic solvent, preferably in a solvent of an azeotropic composition, on an electrically conductive support, followed by drying, an undercoat layer is formed.

Here, by mixing the above organic solvent, dispersibility of the coating liquid is further improved compared to the alcoholic solvent alone, so that it becomes possible to extended the period of storage stability of coating liquid (an elapsed number of days from formation of the coating liquid for an under coat layer is hereinafter, referred to as pot life). Further, in forming an undercoat layer by dip-coating an electrically conductive support in a coating liquid for an under coat layer, coating defect or unevenness of an under coat layer is prevented, and a photosensitive layer to be formed thereon can be applied uniformly, so that it is possible to form an electrophotographic photoreceptor having very excellent image characteristics with no film defect.

The term "azeotropy" used herein means a phenomenon that in a liquid mixture, a composition of a solution and a composition of vapor coincide under a certain pressure, so that a constant boiling point mixture is formed. The composition thereof in the present invention is determined in an arbitrary combination of a mixed solvent of the aforementioned lower alcohol, and an organic solvent selected from the group consisting of dichloromethane, chloroform, 1,2-dichloroethane, 1,2-dichloropropane, toluene, and tetrahydrofuran.

A proportion of the composition is known in the art (see Chemistry Handbook, Basic edition), and in the case of methanol and 1,2-dichloroethane, for example, a solution in which 35 parts by weight of methanol and 65 parts by weight of 1,2-dichloroethane are mixed has the azeotropic composition.

By using the mixed solvent having the azeotropic composition, uniform deposition occurs, and a coating film of the undercoat layer is formed into a uniform film with no coating defect, and also storage stability of the coating liquid for an under coat layer improves.

Since use of halogen-based solvents has been reduced or inhibited because of recent environmental issues and problems of toxicity, it is further preferred to use cyclic ethers.

As these organic solvents, optionally substituted tetrahydrofurans and derivatives thereof, and optionally substituted dioxolane compounds and derivatives thereof can be recited, and particularly preferred is 1,3-dioxolane of all hydrogen atoms with no substituent. When an alkyl group has a substituent of large number of carbons, boiling point of the dioxolane derivative is high, and a boiling point exceeding 100° C. is undesirable because a drying time of the formed undercoat layer increases, and thus not only the productivity decreases but also drying unevenness is likely to occur depending on the coating environment such as air flow and humidity.

As a structure of the photosensitive layer formed on the undercoat layer, a function separated type (laminate type) photosensitive layer made up of a charge generating layer and a charge transporting layer, and a single layer type photosensitive layer in which these layers are implemented by a single layer rather than separated from each other are known, and any of these may be used.

In the case of a function separated type photosensitive layer, a charge generating layer is formed on an undercoat layer. As a charge generating substance comprised in the charge generating layer, bis azo compounds such as chlorodyan blue, polycyclic quinine compounds such as dibromoanthanthrone, perylene compounds, quinacridone compounds, phthalocyanine compounds, azlenium salt compounds and the like are known, however, in an electrophotographic photoreceptor that forms an image by a reversal development process using an optical source such as laser beam or LED, it is requested to have sensitivity in a long wavelength range of 620 nm to 800 nm.

As a charge generating material used in this case, phthalocyanine pigments or trisazo pigments have been conventionally examined because they have high sensitivity and excellent durability. Among these, in particular, phthalocyanine pigments have further excellent characteristics, and these pigments may be used solely or in combination of two or more kinds.

As a phthalocyanine pigment which may be used, nonmetallic phthalocyanine or metallic phthalocyanine, and mixture and mixed crystals thereof can be recited.

As metal that is used in metallic phthalocyanine pigments, for example, those having oxidation state of zero, or halides such as chlorides or bromides thereof, or oxides thereof are used. Preferred metal includes Cu, Ni, Mg, Pb, V, Pd, Co, Nb, Al, Sn, Zn, Ca, In, Ga, Fe, Ge, Ti, Cr and so on. Various techniques have been proposed as a method for producing these phthalocyanine pigments, however, any production method may be used, and a dispersing treatment may be conducted with various organic solvents after forming a pigment, in order to achieve a variety of purifications and conversion of crystal type.

In the present invention, amorphous metals, or metals having α-type, β-type, γ-type, δ-type, ϵ-type, x-type, τ-type and the like crystal types may be used.

As a method for producing a charge generating layer using these phthalocyanine pigments, a method of forming by vacuum vapor deposition of a charge generating substance, in particular, a phthalocyanine pigment, and a method of forming a film by mixing and dispersing a binder resin and an organic solvent are known, however, a grinding treatment may be previously conducted by a grinder prior to the mixing and dispersing treatment. There are known methods that uses a ball mill, a sand mill, an atliter, a vibration mill and an ultrasonic disperser, as such a grinder.

Generally, a method of coating after dispersing into a binder resin solution is preferred. As a coating method, spray method, bar coating method, roll coating method, blade method, ring method, dipping method and the like are recited. Particularly, in the dip coating method as shown in FIG. 1, after dipping an electrically conductive support in a coating bath filled with a coating liquid for photoreceptor such as a coating liquid for a charge generating layer, a coating liquid for a charge transporting layer, or a coating liquid for single-layer type photosensitive layer, the electrically conductive support is drawn up at a constant speed or a gradually varying speed, to form a photosensitive layer. This method is relatively simple, and excellent in terms of productivity and cost, so that it is often used in the case of producing an electrophotographic photoreceptor.

More specifically, in a dip coating apparatus shown in FIG. 1, a coating liquid 12 is accommodated in a coating bath 13 and a stirring bath 14. The coating liquid 12 is sent from the stirring bath 14 to the coating liquid bath 13 through a circulation path 17*a* by a motor 16, and then sent from the coating liquid bath 13 to the stirring bath 14 via an inclined circulation path 17*b* that connects an upper part of the coating liquid bath 13 and an upper part of the stirring bath 14, and circulated in this manner.

Over the coating liquid bath 13, an electrically conductive support 2 is attached to a rotation axis 10. An axial direction of the rotation axis 10 is along with the vertical direction of the coating liquid bath 13, and by rotating the rotation axis 10 by a motor 11, the attached support 2 moves up and down. The motor 11 is rotated in a predetermined one direction to make the support 2 move down to be dipped in the coating liquid 12 inside the coating liquid bath 13.

Next, the motor 11 is rotated in other direction that is opposite to the above one direction to make the support 2 move up, to be drawn out from the coating liquid 12. The support 2 is then dried to form a film by the coating liquid 12.

The dip coating method particularly as shown in FIG. 1 is a method of forming a photosensitive layer by dipping an electrically conductive support in a coating bath filled with a photoreceptor coating liquid and then drawing up the same at a constant speed or a gradually varying speed, and is relatively simple, and excellent in terms of productivity and cost, so that it is often used in producing an electrophotographic photoreceptor.

Therefore, it is desired that a resin for an under coat layer is difficult to be solved in a solvent of a coating liquid for photosensitive layer, and generally, alcohol-soluble or water-soluble resin is used, and a coating liquid for an under coat layer is prepared and applied on the support in the form of alcohol solution or dispersion, and thereby an undercoat layer is formed.

A binding resin used in the photoreceptor coating liquid, melamine resin, epoxy resin, silicon resin, polyurethane resin, acryl resin, polycarbonate resin, polyarylate resin, phenoxy resin, butyral resin and the like, copolymer resins comprising two or more repeating units, for example, vinyl chloride-vinyl acetate copolymer resin, acrylonitrile-styrene copolymer resin and the like insulating resins can be recited in no limitative manner, and any resins that are generally used may be used alone or in combination of two or more kinds without limited to the above.

As a solvent for dissolving these resins, halogenated hydrocarbons such as methylene chloride and ethane dichloride, ketones such as acetone, methylethyl ketone and cylohexanone, esters such as ethyl acetate and butyl acetate, ethers such as tetrahydrofuran and dioxane, aromatic hydrocarbons such as benzene, toluene and xylene, aprotic polar solvent such as N,N-dimethyl formamide and N,N-dimethyl acetamide or mixed solvent thereof may be used.

Film thickness of the charge generating layer is preferably between 0.05 μm and 5 μm, and more preferably between 0.1 μm and 1 μm.

Blending ratio of the phthalocyanine pigment and the binder resin is preferably in the range of 10% by weight to 99% by weight of phthalocyanine pigment. When it is less than this range, the sensitivity decreases, whereas when it is more than this range, not only the durability decreases, but also dispersibility decreases and bulky particles increase, so that image defects, in particular, black spots increase.

In producing a coating liquid for a charge generating layer, the phthalocyanine pigment and the binder resin and the organic solvent are mixed and dispersed, and as a dispersing condition, an appropriate dispersing condition is selected so that contamination of impurities due to abrasion of containers and a dispersing medium being used will not occur.

It is important for the phthalocyanine pigment comprised in the dispersion obtained in the manner as described above, to make dispersion proceed to such a degree that the particle size of a primary particle and/or aggregated particle size thereof is 3 μm or less.

When the primary particle and/or aggregated particle size is more than 3 μm, black spots significantly arise on white a base in the resultant electrophotographic photoreceptor in the case of reversal development. In producing a coating liquid for a charge generating layer by various dispersers, it is preferred to optimize the dispersing condition so that phthalocyanine pigment particles are dispersed to 3 μm or less, and further preferably 0.5 μm or less by a median size or 3 μm or less by a mode size, and larger particles are not comprised.

Phthalocyanine pigment particles require relatively strong dispersing condition and long dispersing time for making microparticles because of their chemical structure, and further proceeding dispersion is ineffective from the view of cost, and contamination of impurities due to abrasion of a dispersing medium or the like is inevitable.

Further, as the crystal type of the phthalocyanine pigment particles changes due to an organic solvent or heat at the time of dispersion, impact by dispersion and the like, an adverse affect that the sensitivity of a photoreceptor greatly decreases arises. Therefore, it is not preferred to make a particle size of a phthalocyanine pigment 0.01 μm or less by a median size, or 0.1 μm or less by a mode size.

Further, when particles of larger than 3 μm are comprised in the phthalocyanine pigment particles in the dispersed coating liquid, primary particles and/or aggregated particles of larger than 3 μm may be removed by conducting a filtration treatment. As the material of filter used in the filtration treatment, those generally used may be used insofar as they will not be swelled or dissolved in an organic solvent, and a membrane filter made of Teflon (trade name) having uniform pore size is preferred. Further, bulky particles and aggregates may be removed by centrifugation.

The charge generating layer formed by using such a coating liquid for a charge generating layer obtained in this manner is applied in a thickness of 0.2 μm to 10 μm. A thicknesses smaller than this are not preferred because a film thickness of the charge generating layer is so small that sensitivity is deteriorated, and a crystal type changes because the phthalocyanine pigment is dispersed too small.

A thicknesses larger than this is not preferred from the viewpoint of cost because exhibited sensitivity is constant, and lead difficulty in achieving uniform coating.

As a producing method of a charge transporting layer provided on the charge generating layer, a method of preparing a coating liquid for charge transportation in which a charge transporting substance is dissolved in a binding resin solution, and applying the same to form a film is commonly used.

As a charge transporting substance comprised in the charge transporting layer, hydrazone-based compounds, pyrazoline-based compounds, triphenyl amine-based compounds, triphenyl methane-based compounds, stilbene-based compounds, oxadiazole-based compounds and the like are known, and these may be used solely or in combination of two or more kinds.

As a binding resin, the aforementioned resins for a charge generating layer may be used solely or in combination of two or more kinds. As a producing method of the charge transporting layer, a method similar to that for the undercoat layer is used.

A film thickness of the charge transporting layer is preferably 5 μm or more and 50 μm or less, and more preferably 10 μm or more and 40 μm or less.

When the photosensitive layer has a single layer structure, a film thickness of the photosensitive layer is preferably in the range of 5 μm or more and 50 μm or less, and more preferably in the range of 10 μm or more and 40 μm or less. At this time, as a preparation method of a coating liquid for single layer, it may be prepared by mixing and dispersing a phthalocyanine pigment and a binder resin solution in which a charge transporting material is dissolved in an organic solvent. An organic solvent and a binder resin used in that case may be those as described above, and as the dispersing method and the coating method, known methods described above may be used.

In both cases of a signal layer structure, and a laminate structure, the photosensitive layer is preferably a negatively charged photosensitive layer in order that the undercoat layer functions as a barrier against hole injection from the electrically conductive support and high sensitivity and high durability are realized.

Also for a purpose of improving sensitivity, and reducing residual potential and fatigue in the case of repeated use, at least one kind of electron-accepting substance may be added to the photosensitive layer For example, quinine-based compounds such as parabenzoquinone, chloranile, tetrachloro 1,2-benzoquinone, hydroquinone, 2,6-dimethylbenzoquinone, methyl 1,4-benzoquinone, α-naphthoquinone and β-naphthoquinone, nitro compounds such as 2,4,7-trinitro-9-fluorenone, 1,3,6,8-tetranitro carbazole, p-nitrobenzophenone, 2,4,5,7-tetranitro-9-fluorenone and 2-nitrofluorenone, and cyano compounds such as tetracyano ethylene, 7,7,8,8-tetracyanoquinodimethane, 4-(p-nitrobenzoyloxy)-2',2'-dicyano vinylbenzene and 4-(m-nitrobenzoyloxy)-2',2'-dicyanovinylbenzene can be recited. Among these, fluorenone-based and quinine-based compounds and benzene derivatives having an electrophilic substituent such as Cl, CN and $NO_2$ are particularly preferred. Further, UV absorbers and antioxidants such as benzoic acid, stilbene compound and derivatives thereof, triazole compounds, imidazole compounds, oxadiazole compounds, thiazole compounds, and derivatives thereof and the like nitrogen-containing compounds may be comprised.

Also, a protective layer may be provided for protecting surface of the photosensitive layer as is necessary.

In the surface protective layer, a thermoplastic resin, or a light- or heat-setting resin may be used.

Also, in the surface protective layer, the above described UV absorbers, antioxidants, inorganic materials such as metal oxides, organic metal compounds and electron-accepting substances may be comprised.

Further, in the photosensitive layer and the surface protective layer, a plasticizer such as dibasic acid ester, fatty acid ester, phosphoric acid ester, phthalic acid ester or chlorinated paraffin may be mixed as necessary to impart workability and flexibility, and to improve the mechanical property, and a leveling agent such as a silicon resin may also be used.

The electrophotographic photoreceptor of the present invention may be used, for example, in an electrophotographic copying machine, various printers using lasers or LED as an optical source, and an electrophotographic plate making system.

EXAMPLES

In the following, Examples of a coating liquid for an undercoat layer of an electrophotographic photoreceptor, a production method thereof an electrophotographic photoreceptor, an image forming apparatus according to the present invention will be specifically explained based on drawings, however, the present invention will not be limited to the following Examples.

Example 1

Figure 3:
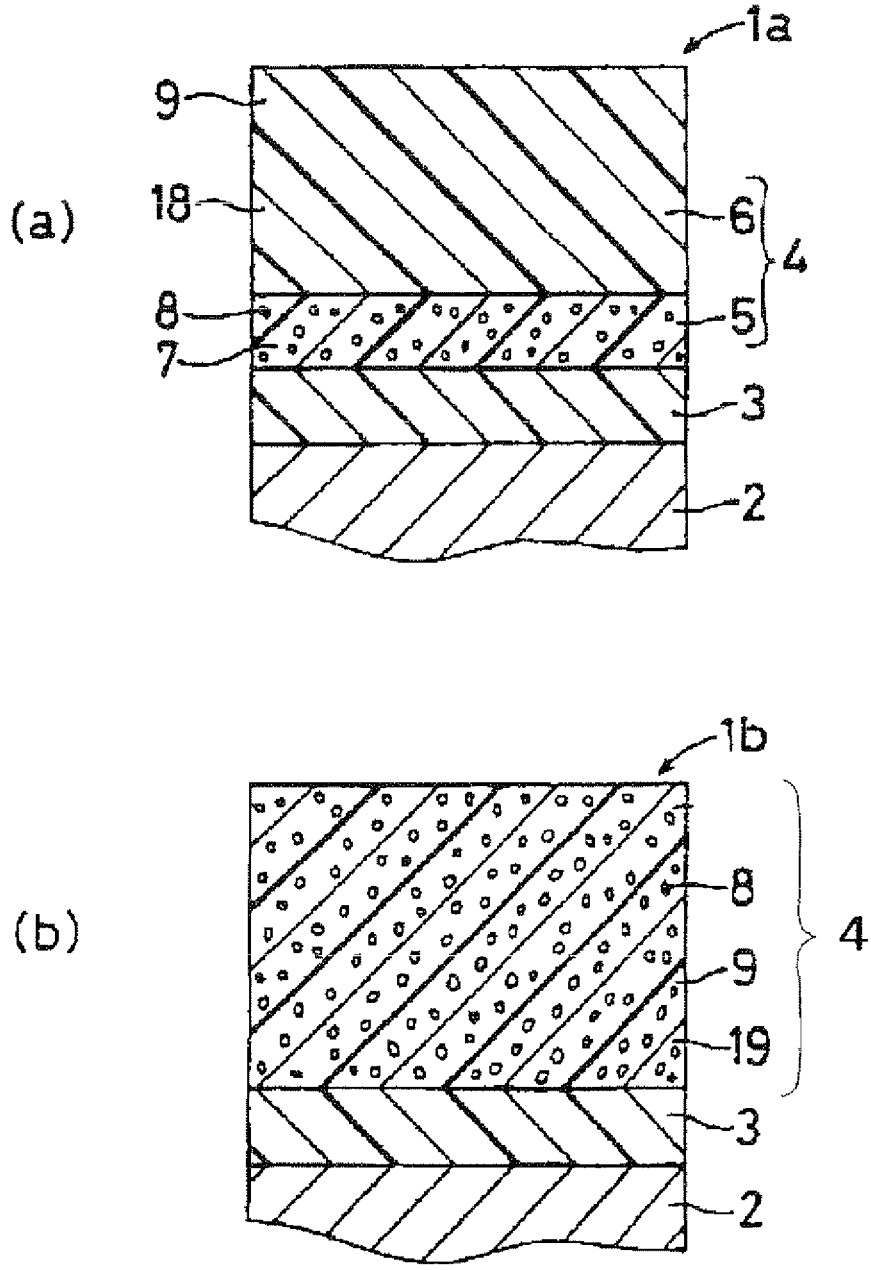
FIG. 3A is a sectional view of an electrophotographic photoreceptor 1*a* which is one embodiment of the present invention, showing a laminate-type photoreceptor composing of three layers, namely, an intermediate layer, a charge generating layer and a charge transporting layer.
FIG. 3B is a sectional view of an electrophotographic photoreceptor 1*b* which is one embodiment of the present invention, showing a single-layer type photoreceptor composed of an intermediate layer and a photosensitive layer.
Figure 4:
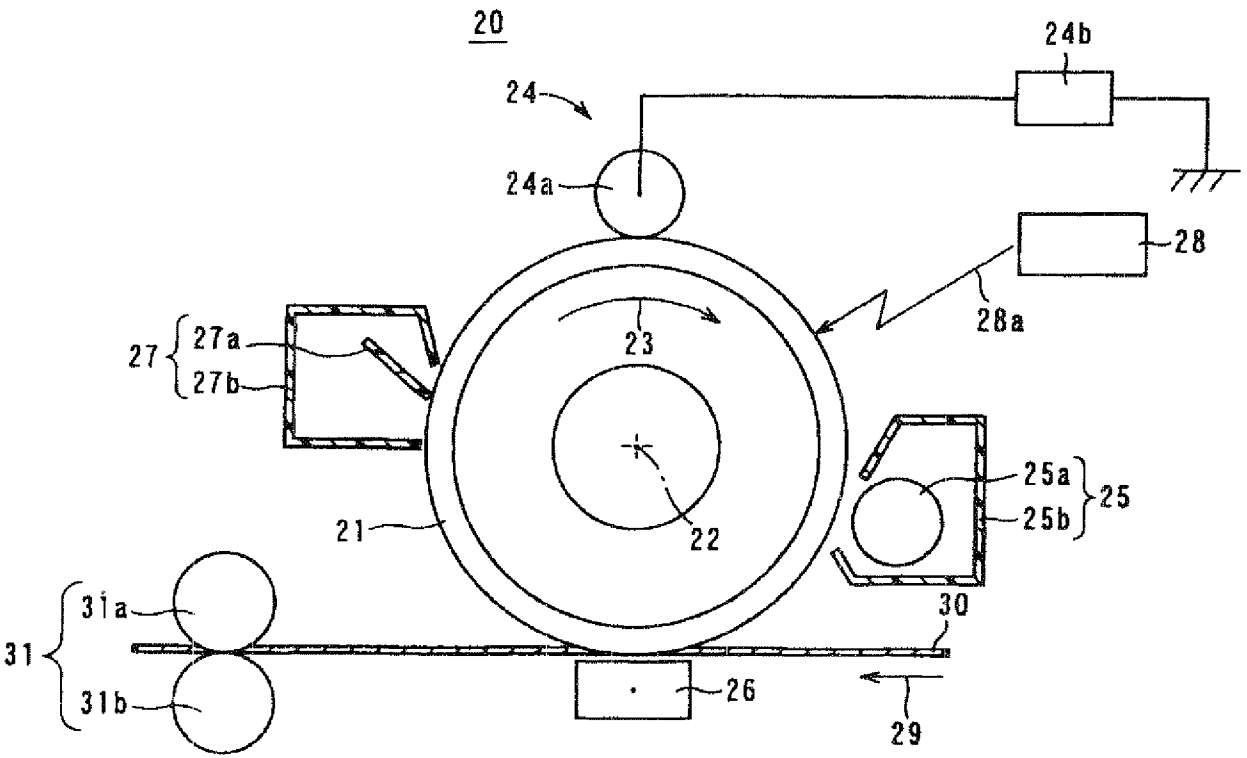
FIG. 4 is one example of an image forming apparatus.

FIG. 3B is a schematic section view of one example of a single layer type electrophotographic photoreceptor of the present invention. As shown in FIG. 3B, an undercoat layer 3 is formed on a electrically conductive support 2, and a photosensitive layer 4 comprising an charge generating substance 8 and a charge transporting substance 19 is formed thereon.

To a 500 mL polypropylene container, the following ingredients and zirconia beads of 1 mm in diameter as a dispersing medium were charged to a half of the capacity, and dispersed for 20 hours with a paint shaker, to prepare 100 mL of a coating liquid for an under coat layer.

[Coating Liquid for an Under Coat Layer]

Titanium oxide (surface untreated, aciculate: STR-60N available from SAKAI CHEMICAL INDUSTRY CO., LTD.): 1 part by weight;

Silicon nitride (SN-E10 available from UBE INDUSTRIES. LTD.): 0.1 part by weight;

Polyamide resin (CM8000 available from TORAY INDUSTRIES, INC.): 0.1 part by weight;

Methanol: 50 parts by weight; and 1,3-dioxylane: 50 parts by weight.

An aluminum electrically conductive support having a thickness of 100 μm was used as the electrically conductive support 1, and the above coating liquid for an under coat layer was applied thereon using a Baker applicator, and hot-air dried at 110° C. for 10 minutes, to produce the undercoat layer 3 having a dry film thickness of 0.05 μm.

Next, after preparing 50 mL of a coating liquid for photosensitive layer by dispersing the following ingredients for 12 hours by using a ball mill, the coating liquid was applied on the undercoat layer by a Baker applicator, and hot-air dried at 100° C. for 1 hour, to provide a photosensitive layer 4 having a dry film thickness of 20 μm, thereby producing a single-layer type electrophotographic photoreceptor 1*b*.

[Coating Liquid for Photosensitive Layer]

τ-type nonmetallic phthalocyanine

Liophoton TPA-891 (available from TOYO INK MFG. CO., LTD.): 17.1 parts by weight;

Polycarbonate resin Z-400 (available from MITSUBISHI GAS CHEMICAL COMPANY, INC.): 17.1 parts by weight;

Phthalocyanine compound represented by the following structural formula (I): 17.1 parts by weight;

Enamine compound represented by the following structural formula (II): 17.1 parts by weight; and Tetrahydrofuran: 100 parts by weight.

Example 2

FIG. 3A is a schematic section view showing one example of a function separated type electrophotographic photoreceptor according to the present invention. As shown in FIG. 3A, the undercoat layer 3 is formed on the electrically conductive support 2, and the photosensitive layer 4 made up of the charge generating layer 5 and the charge transporting layer 6 is stacked thereon. The charge generating layer 5 comprises the charge generating substance 8 and the charge transporting layer 6 comprises a charge transporting substance 18.

To a 500 mL polypropylene container, the following ingredients and zirconia beads of 1 mm in a diameter as a dispersing medium were charged to a half of the capacity, and dispersed for 20 hours with a paint shaker, to prepare 100 mL of a coating liquid for an under coat layer.

[Coating Liquid for Under Coat Layer]

Titanium oxide ($Al_2O_3$ surface treated, aciculate: STR-60 available from SAKAI CHEMICAL INDUSTRY CO., LTD.): 1.9 parts by weight;

Silicon nitride (SN-E10 available from UBE INDUSTRIES. LTD.): 0.1 part by weight;

Polyamide resin (CM8000 available from TORAY INDUSTRIES, INC.): 0.1 part by weight;

Methanol: 35 parts by weight; and 1,3-dioxolane: 65 parts by weight.

An aluminum electrically conductive support having a thickness of 100 μm was used as the electrically conductive support 2, and the above coating liquid for an under coat layer was applied thereon using a Baker applicator, and hot-air dried at 110° C. for 10 minutes, to form the undercoat layer 3 having a dry film thickness of 5 μm.

Next, after preparing 50 mL of a coating liquid for a charge generating layer by dispersing the following ingredients for 12 hours by using a ball mill, the coating liquid wag applied by a Baker applicator, and hot-air dried at 120° C. for 10 minutes, to provide the charge generating layer 5 having a dry film thickness of 0.8 μm.

[Coating Liquid for Charge Generating Layer]

τ-type nonmetallic phthalocyanine

Liophoton TPA-891 (available from TOYO INK MFG. CO., LTD.): 2 parts by weight;

Vinyl chloride-vinyl acetate-maleic acid copolymer resin SOLBIN M (available from Nissin Chemical Industry Co., Ltd.): 2 parts by weight; and Methylethyl ketone: 100 parts by weight.

Further, on the charge generating layer 5, 100 mL of a coating liquid for a charge transporting layer prepared by mixing, stirring and dissolving the following ingredients was applied by a Baker applicator, and hot-air dried at 80° C. for 1 hour, to provide the charge transporting layer 6 having a dry film thickness of 20 μm, thereby producing the function separate type electrophotographic photoreceptor 1*a*.

[Coating Liquid for Charge Transporting Layer]

Phthalocyanine compound represented by the following structural formula (I): 8 parts by weight;

Polycarbonate resin K1300 (available from TEIJIN CHEMICALS LTD.): 10 parts by weight;

Silicon oil KF50 (available from Shin-Etsu Chemical Co., Ltd.): 0.002 part by weight; and Dichloromethane: 120 parts by weight:

Example 3

After forming an undercoat layer in a similar manner as Example 2 except that the coating liquid for an under coat layer used in Example 2 was replaced by the following ingredient, a photosensitive layer was formed in a similar manner as Example 2, and a function separated type electrophotographic photoreceptor was produced.

Titanium oxide ($Al_2O_3$, $ZrO_2$ surface treated, arborescent: TTO-D-1 available from ISHIHARA SANGYO KAISYA, LTD.): 1.9 parts by weight.

Example 4

After forming an undercoat layer in a similar manner as Example 3 except that the coating liquid for an under coat layer used in Example 3 was replaced by the following ingredient, a photosensitive layer was formed in a similar manner as Example 2, and a function separated type electrophotographic photoreceptor was produced.

Polyamide resin (X1010: available from Daicel Degussa): 0.1 part by weight.

Comparative Example 1

After forming an undercoat layer in a similar manner as Example 1 except that the coating liquid for an under coat layer used in Example 1 was replaced by the following ingredient, a photosensitive layer was formed in a similar manner as Example 1, and a single layer type electrophotographic photoreceptor was produced.

[Coating Liquid for an Under Coat Layer]

Titanium oxide (surface untreated particulate, titanium oxide content: 98%)

TTO-55N (available from ISHIHARA SANGYO KAISYA, LTD.) 2 parts by weight

Polyamide resin (CM8000 available from TORAY INDUSTRIES, INC.): 0.1 part by weight;

Methanol: 50 parts by weight; and 1,3-dioxolane: 50 parts by weight.

Comparative Example 2

After forming an undercoat layer using a coating liquid for an under coat layer used in Comparative Example 1, a photosensitive layer was formed in a similar manner as in Example 2, and a function separated type electrophotographic photoreceptor was produced.

Photoreceptors produced by using the undercoat layers prepared in Examples 1 to 4, Comparative Examples 1 and 2, and photoreceptors produced by using coating liquids for an under coat layer after 30 days of pot life were wound and attached to an aluminum drum of a modified machine of a digital copying machine (AR-450M available from SHARP CORPORATION), and evaluation of a white solid image on which the white solid image is printed by a reversal development method and evaluation of a coating liquid for an under coat layer after 30 days of pot life were made according to the following evaluation method.

[Evaluation of Initial White Solid Image]

Printing was conducted with a digital copying machine to which each of the photoreceptors produced in Examples 1 to 4, Comparative Examples 1 and 2 was attached, and an initial white solid image was evaluated according to the following evaluation criteria.

○: No black spotty defect

Δ: Slight black spotty defect x: Significant black spotty defect

–: No data

Further, coating liquids for an under coat layer produced in Examples 1 to 4, Comparative Examples 1 and 2 were stored in dark at room temperature for 30 days, and pot life of each coating liquid was examined, and evaluation after 30 days of pot life was made according to the following evaluation criteria.

○: No aggregation and sedimentation

Δ: Slight sedimentation x: Significant aggregation and sedimentation

Further, photoreceptors were produced by using coating liquids for an under coat layer prepared in Examples 1 to 4, Comparative Examples 1 and 2, having stored in dark at room temperature for 30 days, and these photoreceptors were attached to the digital copying machine and printing was conducted in a similar manner as described above, and a white solid image was evaluated according to the following evaluation criteria.

○: No black spotty defect

Δ: Slight black spotty defect x: Significant black spotty defect

–: No data

The obtained above evaluation results are shown in the following Table.

TABLE 1

| Example | Initial white solid image | After 30 days of pot life | White solid image after pot life |
|---|---|---|---|
| Example 1 | ○ | Δ | Δ |
| Example 2 | ○ | Δ | Δ |
| Example 3 | ○ | Δ | Δ |
| Example 4 | ○ | Δ | Δ |
| Comparative Example 1 | x | x | — |
| Comparative Example 2 | x | x | — |

The above result demonstrates that in evaluation of an initial white image, excellent images without defects are obtained in the printed matters obtained by digital copying machines to which photoreceptors obtained in Examples 1 to 4 are attached. In the printed matters obtained by photoreceptors of Comparative Examples 1 and 2, a large number of black spotty defects occur on images.

Examination of pot life of dispersion after storage of 30 days in dark at room temperature revealed that aggregation of an inorganic compound slightly occurs and slight sedimentation is observed in a coating liquid for the coating liquids for an under coat layer prepared in Examples 1 to 4. At one month of pot life of these coating liquids, photoreceptors were produced respectively in a similar manner as Examples 1 to 4 and evaluated, and slight black spotty defects occurred on images.

Similarly, coating liquids for an under coat layer prepared in Comparative Examples 1 and 2 gave sufficiently uniform coating liquids directly after dispersion, however, when pot life of dispersion after storage of 30 days in dark at room temperature was examined, aggregates of an inorganic compound and sedimentation in lower part of the coating liquid were observed, so that it was impossible to produce an undercoat layer and a problem arose in storage stability.

Therefore, it was impossible to produce a photoreceptor likewise the cases of Examples 1 to 4 by using the coating liquids for an under coat layer prepared in Comparative Examples 1 and 2 after storage of 30 days in dark at room temperature.

Example 5

After putting the following ingredients into a 600 mL horizontal bead mill and filling 80% of the capacity with beads of silicon nitride having a diameter of 0.5 mm as a dispersing medium, the following ingredients were circularly dispersed for 24 hours by pooling the ingredients in a stirring tank and sending to the disperser via a diaphragm pump, to prepare 3000 mL of a coating liquid for an under coat layer.

Coating Liquid for an Under Coat Layer

Titanium oxide ($Al_2O_3$, $ZrO_2$ surface treated, arborescent: TTO-D-1 available from ISHIHARA SANGYO KAISYA, LTD.): 1 part by weight;

Polyamide resin (X1010: available from Daicel Degussa): 9 parts by weight;

Ethanol: 50 parts by weight; and

Tetrahydrofuran: 50 parts by weight.

A coating bath was filled with the coating liquid, and an aluminum cylindrical support having a diameter of 30 mm and a total length of 345 mm as an electrically conductive support was subjected to dip coating to form an undercoat layer having a film thickness of 0.05 μm on the electrically conductive support.

In addition, a micro amount of silicon nitride comprised in the coating liquid was confirmed by fluorescent X-ray measurement.

Then, the mixture of the following ingredients was dispersed by a ball mill for 12 hours, to prepare 2000 mL of a coating liquid for a charge generating layer, and then the coating liquid was applied on the undercoat layer in a similar manner as is the case of the undercoat layer and hot-air dried at 120° C. for 10 minutes, to provide the charge generating layer 5 having a dry film thickness of 0.8 μm.

[Coating Liquid for Charge Generating Layer]

Oxotitanylphthalocyanine: compound represented by the following structural formula [I] in which Bragg's angle (2θ±0.2°) in Cu-kα characteristic X-ray diffraction has a distinct diffraction peak at least at 27.3°: 2 parts by weight;

Polyvinyl butyral resin (S-LEC BM-S available from SEKISUI CHEMICAL CO., LTD.): 2 parts by weight;

Methylethyl ketone: 100 parts by weight, (I)

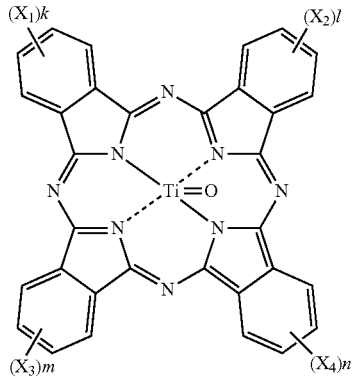

wherein $X_1$ to $X_4$ represent a hydrogen atom, halogen atom, alkyl group or alkoxy group, and k, l, m and n are integers of 0 to 4.

Subsequently, the following ingredients were mixed and dissolved to prepare 3000 mL of a coating liquid for a charge transporting layer, and then the coating liquid was applied on the charge generating layer in a similar manner as is the case of the undercoat layer, dried at 110° C. for 1 hour, to form a charge transporting layer having a film thickness of 23 μm, and a sample of function separated type electrophotographic photoreceptor was produced.

[Coating Liquid for Charge Transporting Layer]

Enamine compound (compound represented by the following structural formula (II)): 10 parts by weight;

Polycarbonate resin (Z200 available from Mitsubishi Engineering-Plastics Corporation): 10 parts by weight;

Silicon oil KF50 (available from Shin-Etsu Chemical Co., Ltd.): 0.02 part by weight; and Tetrahydrofuran: 120 parts by weight, (II)

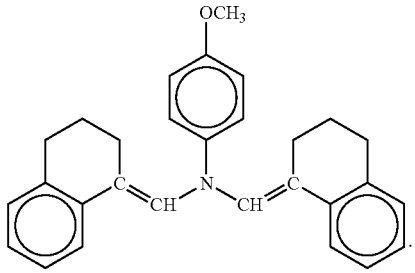

Example 6

3000 mL of a coating liquid for an under coat layer was prepared in a similar manner as Example 5 except that the coating liquid for an under coat layer used in Example 5 was changed to the following ingredients.

[Coating Liquid for Under Coat Layer]

Titanium oxide ($Al_2O_3$, $SiO_2$ surface treated, particulate: MT-500SA available from TAYCA Corporation): 8 parts by weight;

Polyamide resin (X1010: available from Daicel Degussa): 2 parts by weight;

Ethanol: 50 parts by weight; and

Tetrahydrofuran: 50 parts by weight.

A coating bath was filled with the coating liquid, and an aluminum cylindrical support having a diameter of 30 mm and a total length of 345 mm as an electrically conductive support was subjected to dip coating to form an undercoat layer having a film thickness of 1.0 μm on the electrically conductive support.

Then, a charge generating layer, and a charge transporting layer were sequentially formed in a similar manner as Example 5, and a sample of function separated type electrophotographic photoreceptor was produced.

Comparative Example 3

After forming an undercoat layer in a similar manner as Example 5 while preparing a coating liquid for an under coat layer in a similar manner as Example 5 except that the dispersing medium was changed to those made of zirconia of 0.5 mm in producing the coating liquid for an under coat layer used in Example 5, a charge generating layer, and a charge transporting layer were sequentially formed, and a sample of function separated type electrophotographic photoreceptor was produced.

Comparative Example 4

After forming an undercoat layer in a similar manner as Example 5 while preparing a coating liquid for an under coat layer in a similar manner as Example 6 except that the dispersing medium was changed to those made of zirconia of 0.5 mm in producing the coating liquid for an under coat layer used in Example 6, a charge generating layer, and a charge transporting layer were sequentially formed, and a sample of a function separated type electrophotographic photoreceptor was produced.

The sample of an electrophotographic photoreceptor thus produced was mounted to a digital copying machine (AR-450M available from SHARP CORPORATION), and charge potential V0 and surface potential VL after laser exposure at normal temperature/normal humidity (22° C./65%), and potential variation ΔVL at low temperature/low humidity (5° C./20%) were measured as a stability test of electric characteristics. Also, image characteristics were examined at initial stage, and after completion of aging of actual printing of 10,000 sheets as a durability test. These results are shown in the table below.

TABLE 2

| | N/N potential characteristics | | L/L potential variation | Image evaluation | |
|---|---|---|---|---|---|
| | $V_0$ (V) | $V_L$ (V) | $\Delta V_L$ (V) | Initial | After repeated use |
| Example 5 | −520 | −60 | −13 | Excellent | Excellent |
| Example 6 | −519 | −61 | −15 | Excellent | Excellent |
| Comparative Example 3 | −523 | −85 | −65 | Fogging, black spot | Fogging, black spot |
| Comparative Example 4 | −521 | −65 | −41 | Black spot | Fogging, black spot |

As shown in Examples 5 and 6 in the above table, very stable potential is exhibited not only in the N/N environment but also in the case of environmental change as evidenced by unimpaired ΔVL. Also in the image evaluation, occurrence of fogging and black spotty defects was not observed, and excellent image quality was evidenced.

On the other hand, in Comparative Example 3, potential of VL was high even in initial stage, and sensitivity was poor, and occurrence of fogging and black spotty defect was observed. Also, sensitivity decrease due to environmental change and image defect were significantly deteriorated. Also in Comparative Example 4, deterioration in image quality occurred after environmental change and repeated use likewise Comparative Example 3, although fogging was not observed in initial image.

Fluorescent X-ray analysis of the coating liquids for an under coat layer produced in Example 5, 6 demonstrated that silicon nitride microparticles were comprised in proportions of 0.013, and 0.012, respectively, relative to dispersed titanium oxide 1.

That is, it is conceivable that when a coating liquid for an under coat layer is dispersed by a horizontal bead mill, not only effects on sensitivity decrease or environmental change were achieved by preventing the dispersion from being denatured by heat owing to high heat conductivity of silicon nitride which is a dispersing medium, in cooling inside the disperser of very high temperature, with a chiller, but also occurrence of black spotty defect is prevented by formation of uniform film quality by silicon nitride in the undercoat layer through some interaction.

In the same manner as the evaluation of white solid of printed matter printed by using photoreceptors according to Examples 1 to 4, Comparative Examples 1 and 2 and a coating liquid for an under coat layer, a pot life was examined for coating liquids for an under coat layer produced in Examples 5 and 6 and Comparative Examples 3 and 4 by storing 30 days in dark at room temperature. The result is shown below.

TABLE 3

| Example | Initial white solid image | After 30 days of pot life | White solid image after pot life |
|---|---|---|---|
| Example 5 | ○ | ○ | ○ |
| Example 6 | ○ | ○ | ○ |
| Comparative Example 3 | Δ | x | x |
| Comparative Example 4 | Δ | x | x |

As a result, aggregation and sedimentation of an inorganic compound were not observed in Examples 5 and 6.

Furthermore, at 30 days of pot life, respective photoreceptors were produced and evaluated in a similar manner as in Examples 5 and 6, and no black spotty defect was observed on image. However, in the case of Comparative Examples 3 and 4, aggregation and sedimentation of an inorganic compound slightly occurred and many black spotty defects were observed at 30 days of pot life.

What is claimed is:

1. A coating liquid to form an undercoat layer of an electrophotographic photoreceptor, said photoreceptor comprising sequentially stacked layers comprising the undercoat layer and a photosensitive layer on an electrically conductive support, the coating liquid comprising titanium oxide microparticles and silicon nitride microparticles as inorganic compounds, a polyamide binder resin and an organic solvent, said silicon nitride microparticles being present the coating liquid in an amount of 1.2 to 10% by weight relative to the titanium oxide microparticles, said microparticles, binder resin and solvent having been dispersed in said coating liquid with a dispersing medium.

2. The coating liquid according to claim 1, wherein the titanium oxide microparticles each have an acicular or arborescent shape.

3. The coating liquid according to claim 1, wherein a weight ratio of the inorganic compound to the binder resin is 10/90 to 95/5.

4. An electrophotographic photoreceptor which is formed by stacking an undercoat layer and a photosensitive layer on an electrically conductive support, the undercoat layer comprising titanium oxide microparticles and silicon nitride microparticles as inorganic compounds and a polyamide binder resin, said silicon nitride microparticles being present the undercoat layer in an amount of 1.2 to 10% by weight relative to the titanium oxide microparticles, said microparticles and binder resin having been dispersed in forming the undercoat layer in a coating liquid with a solvent and a dispersing medium.

5. The electrophotographic photoreceptor according to claim 4, wherein a film thickness of the undercoat layer is between 0.05 μm and 5 μm.

6. A method for producing a coating liquid for an undercoat layer of an electrophotographic photoreceptor, the coating liquid comprising dispersing titanium oxide microparticles or titanium oxide microparticles and silicon nitride microparticles as inorganic compounds and a polyamide binder resin in an organic solvent, said silicon nitride microparticles being present the coating liquid in an amount of 1.2 to 10% by weight relative to the titanium oxide microparticles, said microparticles, binder resin and solvent having been dispersed in said coating liquid with a dispersing medium.

7. The method according to claim 6, wherein when the titanium oxide microparticles and the binder resin are dispersed in the organic solvent, said dispersing medium comprising silicon nitride.

8. An image forming apparatus equipped with the electrophotographic photoreceptor according to claim 4.

9. The coating liquid according to claim 1, wherein the dispersing medium comprises beads of silicon nitride and said silicon nitride microparticles of the coating liquid originate in the beads and the titanium oxide microparticles each have an arborescent or particulate shape.

* * * * *